United States Patent [19]

Schroeder

[11] 3,978,930

[45] Sept. 7, 1976

[54] EARTH DRILLING MECHANISMS

[75] Inventor: Rondon L. Schroeder, Wichita, Kans.

[73] Assignee: Continental Oil Company, Ponca City, Okla.

[22] Filed: Nov. 14, 1975

[21] Appl. No.: 632,092

[52] U.S. Cl. ..... 175/94; 175/99; 175/230

[51] Int. Cl.[2] ..... E21B 3/12; E21C 19/00

[58] Field of Search ..... 175/94, 98, 99; 173/32, 173/34

[56] References Cited

UNITED STATES PATENTS 3,180,437 4/1965 Kellner et al. ..... 175/230

3,827,512 8/1974 Edmond ..... 175/94

*Primary Examiner*—James A. Leppink

*Attorney, Agent, or Firm*—William J. Miller

[57] ABSTRACT

An apparatus of the type used in forming boreholes in earth formations, as particularly utilized in and about mining operations, which includes the addition of thrust force accumulator structure which enables a continuous drilling progression during the cyclical actuation of alternating borehole anchor mechanism. The device utilizes a conventional form of drill motor and drill bit coupled with a particular form of piston/-cylinder anchor mechanism which functions in coaction with a force accumulator compression spring.

5 Claims, 2 Drawing Figures

EARTH DRILLING MECHANISMS

BACKGROUND OF THE INVENTION

1.

The invention relates generally to earth drilling apparatus and, more particularly, but not by way of limitation, it relates to an improved drilling apparatus which utilizes a force accumulator to enable continuous drill progression.

2.

There are various forms of prior art drilling device which are driven either hydraulically, electrically or pneumatically to provide borehole formation in and around mines. One type of drilling apparatus which should be noted is a device manufactured by Drilco Corporation of Midland, Texas which consists essentially of a hydraulic piston functioning in coaction with two sets of borehole wall anchors, as alternately actuated, to progress by intermittent operation through the earth formation. The device operates by pressuring one set of borehole wall anchors to engage the wall, and increasing pressure on the piston to drive the piston forward to force the drill stem. When the piston has reached its limit, a second set of anchors is pressurized forcing them against the borehole wall while the original set of borehole anchors is disengaged, and the piston assembly is then retracted to a new position as anchored by the second set of anchors, whereupon the first set of anchors is then repressurized and the second set of anchors is retracted, and the process is carried out repeatedly. The drill progression is intermittent because the retracting of the piston allows no pressure to be applied to the drill, thus reducing the drill time by the time required to retract the first set of anchors and move the piston and anchor assembly to the next location. Finally, additional prior art of note is U.S. Pat. No. 3,827,512 entitled "Anchoring and Pressuring Apparatus for a Drill" as patented on August 6, 1974 in the name of Tibor O. Edmond and owned by the present assignee.

SUMMARY OF THE INVENTION

The present invention contemplates an earth borehole drilling apparatus capable of effecting continuous drill progression through an earth formation. The invention consists of a serial array of piston, cylinder and force accumulator serving to continually advance a drill motor and drill bit through an earth formation, the cylinder and piston including alternately actuated dogs or borehole anchor assemblies while a force accumulator in the form of a compression spring stores force during the period when cylinder anchors are actuated, later to be released during the period when piston anchors are actuated, such actuations being carried out cyclically while the drill bit advances at a relatively constant rate.

Therefore, it is an object of the present invention to provide an improved earth drilling machine capable of continual and constant drilling progression.

It is also an object of the present invention to provide a borehole drill which includes a force accumulator for storage of mechanical energy which is released during the drill bit reset cycle thus enabling further drill progress for that duration.

It is another object of the present invention to provide an earth borehole drill bit capable of a greater overall drilling rate.

It is still further another object of the present invention to provide an earth borehole drilling bit wherein shock loading of the bit is lessened to increase drill bit life.

Finally, it is an object of the present invention to provide an earth borehole drill bit which receives a more nearly constant load on the drive motor and power train such that there results a more positive guidance control during operation.

Other objects and advantages of the invention will be evident from the following detailed description when read in conjunction with the accompanying drawings which illustrate the invention.

DETAILED DESCRIPTION OF THE PREFERRED EMBODIMENT

Figure 1:
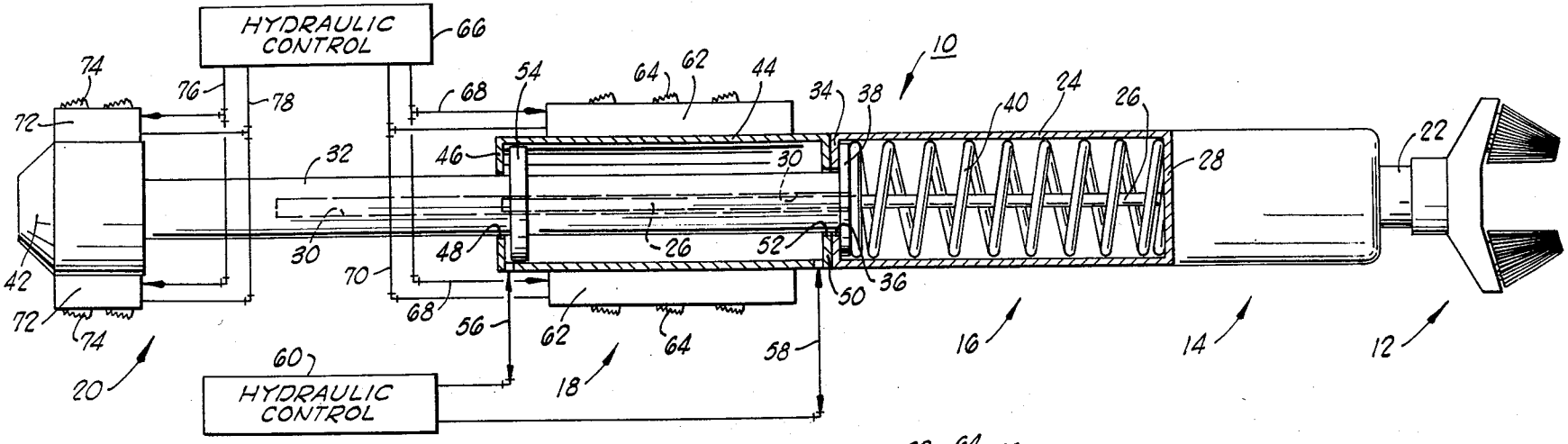
FIG.1 is a schematic representation in partial section of a drilling apparatus constructed in accordance with the present invention.

Referring now to FIG. 1, a drilling apparatus 10 consists of a drill bit 12, a drill motor 14, a force accumulator section 16, cylinder 18 and piston 20. The drill bit 12 is a conventional and commercially available type of drill bit which finds usage in earth drilling systems, and particularly as utilized for longitudinal boring in mines and the like. The drill bit 12 is rotationally powered by a drill motor 14 of selected size and power rating, and the basic power source for drill motor 14 may be any of hydraulic, pneumatic, electrical or combinations thereof.

The drill motor 14 is then supported serially and in-line with an accumulator 16 as disposed within a suitably formed housing 24 which is welded or secured by suitable fastening techniques to the rear end of drill motor 14. A guide rod 26 is rigidly secured to forward end 28 of housing 24 to extend centrally, axially therethrough and into a rod bore 30 of piston rod 32, as will be further described. A rearward end 34 of housing 24 is formed with a central circular opening 36 through which piston rod 32 is slidably inserted through opening 36 wherein it takes the shape of a unitarily formed flange foot 38 having complementary internal cross-section similar to that of the interior of housing 24. This is essentially a circular flange foot 38 slidably movable within a cylindrical housing 24 in keeping with component shaping specifications which are well-known in the borehole and drilling technology. Further disposed along the length of the interior of housing 24 is a compression spring 40 which functions as the force accumulator as it is disposed along the length of housing 24 between forward wall 28 and flange foot 38.

The piston rod 32 then extends rearwardly through cylinder 18 for termination in a piston housing 42. The cylinder 18 consists of a cylinder housing 44 having a rear wall 46 with axial opening 48, and having a forward wall 50 with axial opening 52. Each of accumulator opening 36 and cylinder opening 52 are sealingly affixed about piston rod 32 by means of conventional sealing practices well-known in the art, and cylinder housing 44 is not secured to housing 24 thereby to allow relative movement therebetween. A hydraulic piston 54 is then rigidly affixed on piston rod 32 for reciprocal pressure-forced movement within cylinder housing 44 under application of hydraulic pressure via lines 56 and 58 from a conventional form of hydraulic control 60. A plurality of multi-latch anchor assemblies 62 are then rigidly secured about the outside of housing 44. Each of anchor assemblies 62 includes a plurality of aligned anchors 64. The number of anchor assemblies 62 utilized on cylinder housing 44 are a matter of design choice in accordance with the exigencies of the particular drill operation, e.g. there may be a quadrature array therearound or, as shown in U.S. Pat. No. 3,827,512, aforementioned, an equi-spaced triple array may be utilized.

There are several forms, variously powered, of latching anchors and anchor assembly 62 which may be utilized in the present invention, and latching power may be derived from hydraulic control 66 as applied through input conduit 68 with return via conduit 70. As depicted, anchors 64 are shown in their retracted position; however, upon actuation of hydraulic power from hydraulic control 66, including the conventional reservoir or storage facilities, the anchors 64 are extended radially outward in unison and locked under high hydraulic pressure into engagement with the side of the surrounding borehole.

The piston housing 42 also provides support for rearward anchor assemblies 72 having plural, aligned anchors 74 extendable therefrom under separate control from hydraulic control 66 via input line 76 and return line 78. The hydraulic control 66 includes conventional mechanism for separately activating anchor assemblies 62 and anchor assemblies 72, alternately, as the drill apparatus 10 progresses through its operative cycles.

Figure 2:
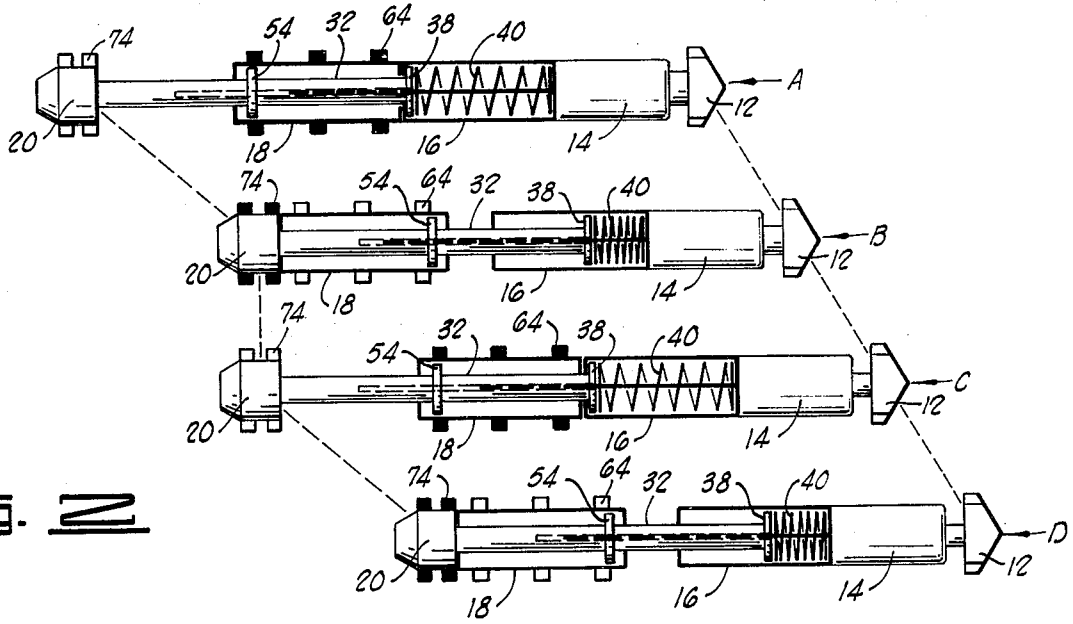
FIG. 2 is a showing in idealized form of the interaction of components of the drilling apparatus of FIG. 1 as it progresses through an operational drilling cycle.

In operation, the drill apparatus 10 including force accumulator 16 provides an apparatus which is capable of storing mechanical energy in the accumulator during a portion of its cyclical operation. This not only maintains a load on the drill bit during the reset cycle, thereby preventing undesirable free spin, but it also causes the drill bit 12 to make further progress into the earth formation during the reset cycle. FIG. 2 illustrates positioning of the individual operative elements as piston 20 and cylinder 18 are alternately anchored while drill bit 12 progresses steadily into the earth formation. In FIG. 2, it should be noted that the anchors shown in black are in the fixed or extended position while those shown in white are retracted.

In FIG. 2, position A represents the condition of drilling apparatus 10 at the beginning of the working cycle. In this attitude, the cylinder anchors 64 are set or extended, whereupon hydraulic control 60 is activated to move cylinder piston 54 and piston 20 forward while at the same time forcing flange foot 38 against compression spring 40. During this period, the drill motor 14 is activated to rotate drill bit 12 into the earth formation. Hydraulic pressure applied within cylinder 18 is made sufficient to overcome bias of spring 40 as well as the resistance of the earth formation against drill bit 12. Without the use of accumulator 16, the velocity of movement of drill bit 12 would be limited directly by the drilling rate; however, with insertion of accumulator 16 of predetermined compressibility, the piston 20 may be moved forward at a rate approximately twice as fast as the drilling rate of drill bit 12 thereby causing the spring 40 to be compressed during this portion of the cycle.

Depiction B represents the result of the first cycle of operation wherein piston 20 has been moved twice as far as drill bit 12 with compression of accumulator spring 40. At this point, hydraulic control 66 is actuated to set or extend piston anchors 74 and to release cylinder anchors 64. Hydraulic control 60 is then reversed such that cylinder 18 is forced in the opposite direction on cylinder piston 54 and, simultaneously, the force accumulator 16 forces drill bit 12 forward thereby expending its stored energy.

At the end of the B cycle the drill apparatus 10 is once again in the starting attitude as shown by depiction C while depiction D represents yet another half cycle of forward movement. Thus, it may be noted from the spatial relationships of A, B, C and D that drill bit 12 as rotated by drill motor 14 has moved ahead at a constant rate throughout the cyclical operation while piston 20 has moved irregularly. Piston 20 has been moved twice the distance of drill bit 12 during the A/B half cycle, and piston 20 receives no forward movement during constant movement ahead of drill bit 12 during the B/C half cycle. Thus, there is no downtime during which drill bit 12 is not forced ahead due to the necessary adjustments of cylinder 18 and alternate latching of anchors 64 and 74; that is, it is illustrated that the pulsing progress of piston 20 is clearly converted into a steady movement mode at drill bit 12.

The foregoing discloses a unique earth borehole drilling apparatus which has the capability of continuously drilling without requiring a reset cycle during which associated hydraulic equipment is restored to an initial position. The present invention utilizes a force accumulator for storage of mechanical energy during a portion of the reset cycle thereby maintaining forward movement of the drilling bit. While the invention is particularly described relative to the use of a compression spring as a force accumulation device, energy may be stored by any of conventional mechanical, pneumatic, or hydro-pneumatic means or by a combination of such so long as the requisite force in complementation to the force of the associated hydraulic cylinder is provided.

Changes may be made in the combination and arrangment of elements as heretofore set forth in the specification and shown in the drawings; it being understood that changes may be made in the embodiments disclosed without departing from the spirit and scope of the invention as defined in the following claims.

What is claimed is:

1. An improved apparatus for drilling a borehole, comprising;

a drill head including a drill bit and drill motor for powering the drill bit;

a housing including a force accumulator affixed to the drill motor;

a piston including a piston rod extending in sliding engagement with the force accumulator;

a cylinder around the piston and adapted for bi-directional movement along the piston rod;

at least one first anchor assembly disposed on the outer periphery of the cylinder;

at least one second anchor assembly disposed about the outer periphery of the piston rod;

hydraulic control means connected to the anchor assemblies to provide alternate selective actuation of the first and second anchor assemblies into earth engaging affixture within said borehole; and hydraulic control means connected to the cylinder to provide selective movement of the cylinder relative to the piston rod.

2. Apparatus as set forth in claim 1 wherein said piston and said piston rod comprises:

a piston housing supporting said at least one second anchor assembly;

a piston rod rigidily secured to and axially extending from said piston housing;

a hydraulic piston formed intermediately on the piston rod means to be reciprocally retained within said cylinder; and flange means formed on the end of said piston rod for insertion in said housing to actuate said force accumulator.

3. Apparatus as set forth in claim 2 which is further characterized to include:

a central axial bore formed through said flange into said piston rod; and a guide rod rigidly secured in said housing and extending axially within said bore for reciprocal movement therein.

4. An apparatus as set forth in claim 1 wherein said housing including force accumulator comprises:

a cylinder enclosure secured at one end to said drill motor and having an axial bore at the other end for reciprocally receiving said piston rod therethrough; and compression spring means disposed within the cylindrical enclosure substantially along the length thereof and in secure contact with said piston rod.

5. An apparatus as set forth in claim 3 wherein said housing including force accumulator comprises:

a cylindrical enclosure secured at one end to said drill motor and having an axial bore at the other end for reciprocally receiving said piston rod therethrough; and compression spring means disposed within the cylindrical enclosure substantially along the length there of and in secure contact with said flange means.

* * * * *

UNITED STATES PATENT OFFICE

CERTIFICATE OF CORRECTION

PATENT NO. : 3,978,930

DATED : September 7, 1976

INVENTOR(S) : Rondon L. Schroeder

It is certified that error appears in the above-identified patent and that said Letters Patent are hereby corrected as shown below:

Column 4, line 53, after "engagement" insert --into the housing and into engagement--

Signed and Sealed this

Twenty-third Day of November 1976

[SEAL]

*Attest:*

RUTH C. MASON
*Attesting Officer*

C. MARSHALL DANN
*Commissioner of Patents and Trademarks*